US005855513A

United States Patent [19]

Lam

[11] Patent Number: 5,855,513

[45] Date of Patent: Jan. 5, 1999

[54] ELECTRONIC MATCHING AND POSITION GAME

[75] Inventor: Clive Lam, Kwun Tong, Hong Kong

[73] Assignee: Tiger Electronics, Ltd., Vernon Hills, Ill.

[21] Appl. No.: 701,524

[22] Filed: Aug. 26, 1996

[51] Int. Cl.[6] ..... A63F 9/24

[52] U.S. Cl. ..... 463/9; 273/237; 273/271

[58] Field of Search ..... 463/1, 9, 14, 10, 463/30, 31, 16, 36, 35; 273/237, 238, 138.1, 138.2, 139, 273, 271, 260

[56] References Cited

U.S. PATENT DOCUMENTS

| | | | |
|---|---|---|---|
| 4,019,745 | 4/1977 | Mustelier | 463/14 |
| 4,207,087 | 6/1980 | Morrism et al. | 463/9 |
| 4,275,442 | 6/1981 | Underwood et al. | 364/410 |
| 4,285,517 | 8/1981 | Morrism | 463/9 |
| 4,359,220 | 11/1982 | Morrism et al. | 273/273 |
| 4,363,482 | 12/1982 | Goldfarb | 463/9 |
| 5,129,654 | 7/1992 | Bogner | 273/238 |
| 5,742,796 | 4/1998 | Orak et al. | 463/9 |

OTHER PUBLICATIONS

Electronic game known as "Copy Cat," shown on p. 71 (copyright 1995) from Tiger Electronics, Inc. 1995 product catalog, published prior to Aug. 26, 1995.

Electronic game known as "Brain Bash," shown on pp. 90–91 (copyright 1995) from Tiger Electronics, Inc. 1995 product catalog, published prior to Aug. 26, 1995.

Electronic game known as "Merlin," by Parker Brothers Div. of General Mills Fun Group, Inc., copy of rules and instructions, copyright 1978.

Instructions for an electronic game known as "R2–D2 Ditto Droid," Model 88–031, 1997 Tiger Electronics, Inc. (2 pages).

Instructions for an electronic game known as "Pocker Simon," 1995 Milton Bradley Company, 4046 REV Aug. 1995. (4 pages).

Instructions for a board game "Concentration", copyright 1982 Milton Bradley Co. (3 pages).

*Primary Examiner*—Jessica J. Harrison
*Assistant Examiner*—Mark A. Sager
*Attorney, Agent, or Firm*—Fitch, Even, Tabin & Flannery

[57] ABSTRACT

A game has a housing with a plurality of spaces defined on the exterior of the housing. Each of the spaces has a space input device and space indicator associated with the space, and each space indicator has an off-state and an on-state. Inside of the housing is a controller which communicates with each of the space input devices and space indicators and also with a select input device. The controller is responsive to activation of the select input device followed by activation of a predetermined one of the space input devices for causing the space indicator corresponding to the space selected by the activated space input device to go to the on-state.

11 Claims, 5 Drawing Sheets

POWER UP
60
68
SELECT PLAYERS
SINGLE PLAYER
70
ACTIVATE COMPUTER OPPONENT
PRACTICE/MULTI PLAYER
START
72
SHUFFLE SOUNDS
74
COMPUTER OPPONENT
76
SELECT
ATTEMPT MATCH
78
80
IS THERE A MATCH?
NO
YES
82
LIGHT UP BUTTON
84
ARE THERE 4 IN A ROW?
NO
YES

ELECTRONIC MATCHING AND POSITION GAME

BACKGROUND OF THE INVENTION

This invention relates to games, and more particularly to a game wherein each player attempts to activate a predetermined number of indicators in predetermined pattern.

In the novel game according to the invention, the player is awarded spaces by correctly selecting a space having an associated human perceptible indication which matches a previously given indication. Thus, with a plurality of spaces and indications, and with a different indication to be matched being given with each turn, the game becomes one of memory and matching skills.

Various games, such as Tic-Tac-Toe, are known in which two players alternate placing symbols in a grid or array until one of the players aligns three (or more, in some variants) symbols linearly, either horizontally, vertically or diagonally within the array to win the game, or until all of the spaces in the array are filled. When all of the spaces in the array are filled without either player having achieved three (or more) linearly aligned symbols, the game is declared a draw.

A matching game called "Simon" is known, in which a sequence of colored lights is illuminated by an electronic game controller, and the player attempts to activate colored buttons in the same sequence. In yet other matching games, using standard playing cards, or specialized playing cards, an effort is made to match the images or symbols on cards which are face down with a card which is face up, for example.

While all of the foregoing games are enjoyable, they have certain limitations. For example, Tic-Tac-Toe because of its simplicity and the tendency to result in frequent draws does not provide much interest for older children and adults, but is enjoyed mainly by younger children. Moreover, Tic-Tac-Toe requires two players, and cannot be played by a single player or by more than two players. The various matching games have somewhat limited objectives and tend to provide only a limited degree of entertainment and excitement to players.

SUMMARY OF THE INVENTION

The inventive game combines the features of aligning symbols of Tic-Tac-Toe with the matching challenge of various matching games, and challenges players both to remember the spaces or locations corresponding to various indications and to attempt to align spaces identified with matching indications into a preselected game-winning alignment.

The inventive game has an array of spaces, each of which has an indicator which when activated indicates that a match has been achieved between a human perceptible indication associated with that space and a human perceptible indication to be matched, which is given, and preferably changed, on each turn. The objective of a player is to achieve a predetermined pattern of activated indicators by being the player to achieve a match and thereby activate the last indicator in the pattern, regardless of which player or players have activated previous indicators in the pattern.

The inventive game, unlike many other games, can be played by a single player, playing against the game device, or even playing individually in a practice mode. On the other hand, the inventive game can be enjoyed by two or more players, since more than two players can also compete in attempting to activate the last indicator a predetermined winning pattern.

DESCRIPTION OF THE ILLUSTRATED EMBODIMENT

Figure 1:
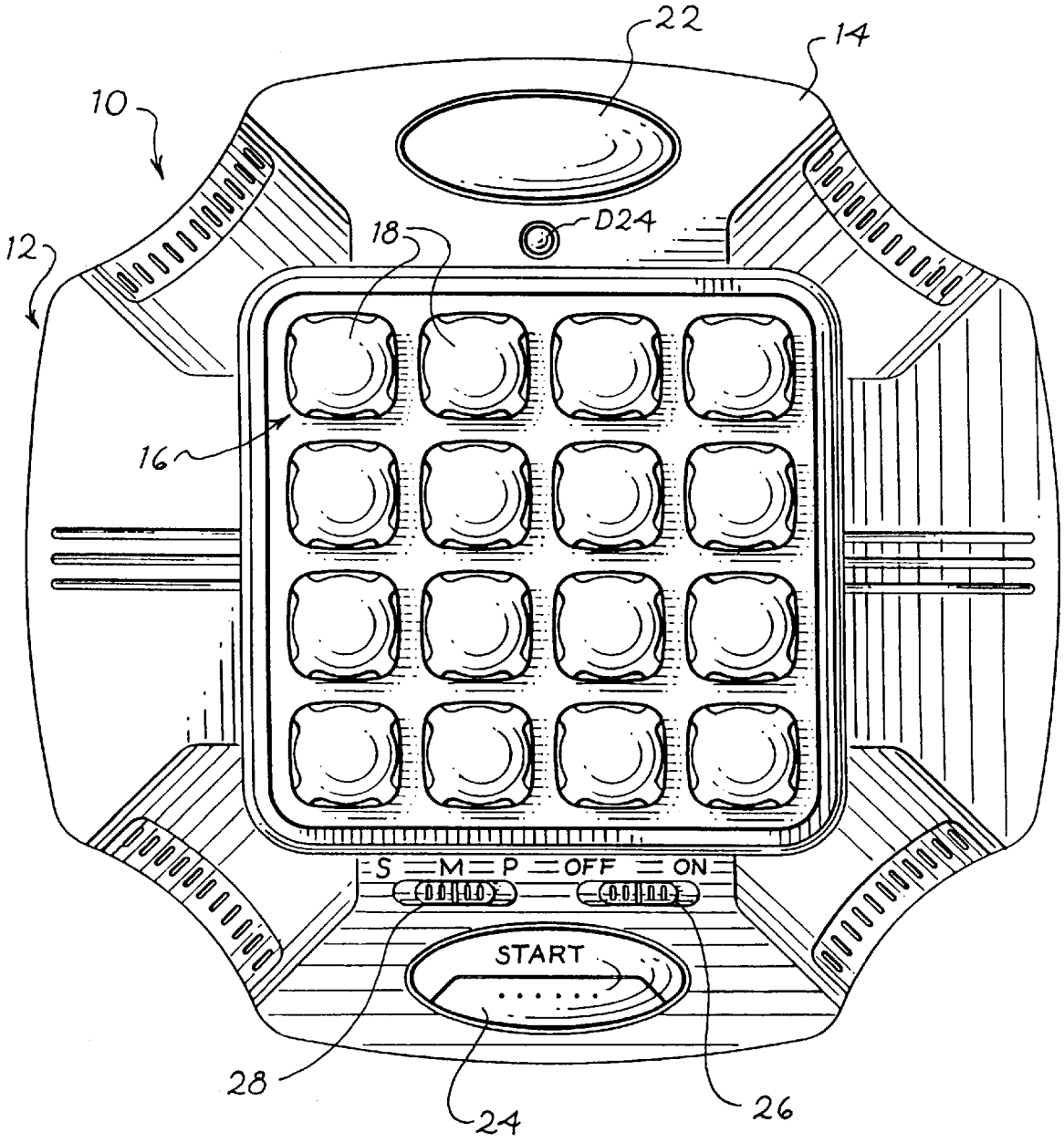
FIG. 1 is a top plan view of a game in accordance with the invention.

Referring now to the drawings and initially to FIG. 1, there is shown an electronic game according to the invention, and designated by the reference numeral 10. The game 10 comprises a housing 12 having an exterior 14, a top plan view of which is illustrated in FIG. 1. The housing exterior 14 has a plurality of spaces 16 defined thereon.

In the illustrated embodiment, the spaces 16 are sixteen in number, arranged in a four-by-four square array. A space input device, which in the illustrated embodiment takes the form of a button 18, is disposed in each space 16. A space indicator, which in the illustrated embodiment takes the form of an illumination means such as a light emitting diode (LED) 20 (see FIG. 3) is also associated with each of the spaces 16. The space indicator for each space is located for illuminating the corresponding space input device 18, preferably by providing the buttons 18 of a translucent or transparent material and disposing an illumination means 20 directly beneath each button 18.

In the embodiment shown in FIG. 1, the game also includes a select input device 22 which also takes the form of a button, as well as a start button 24, and an on/off switch 26. A player select switch 28 may be moved to one of three positions S, M and P, indicating single player, multiple player or practice, to select a game mode.

Figure 3A:
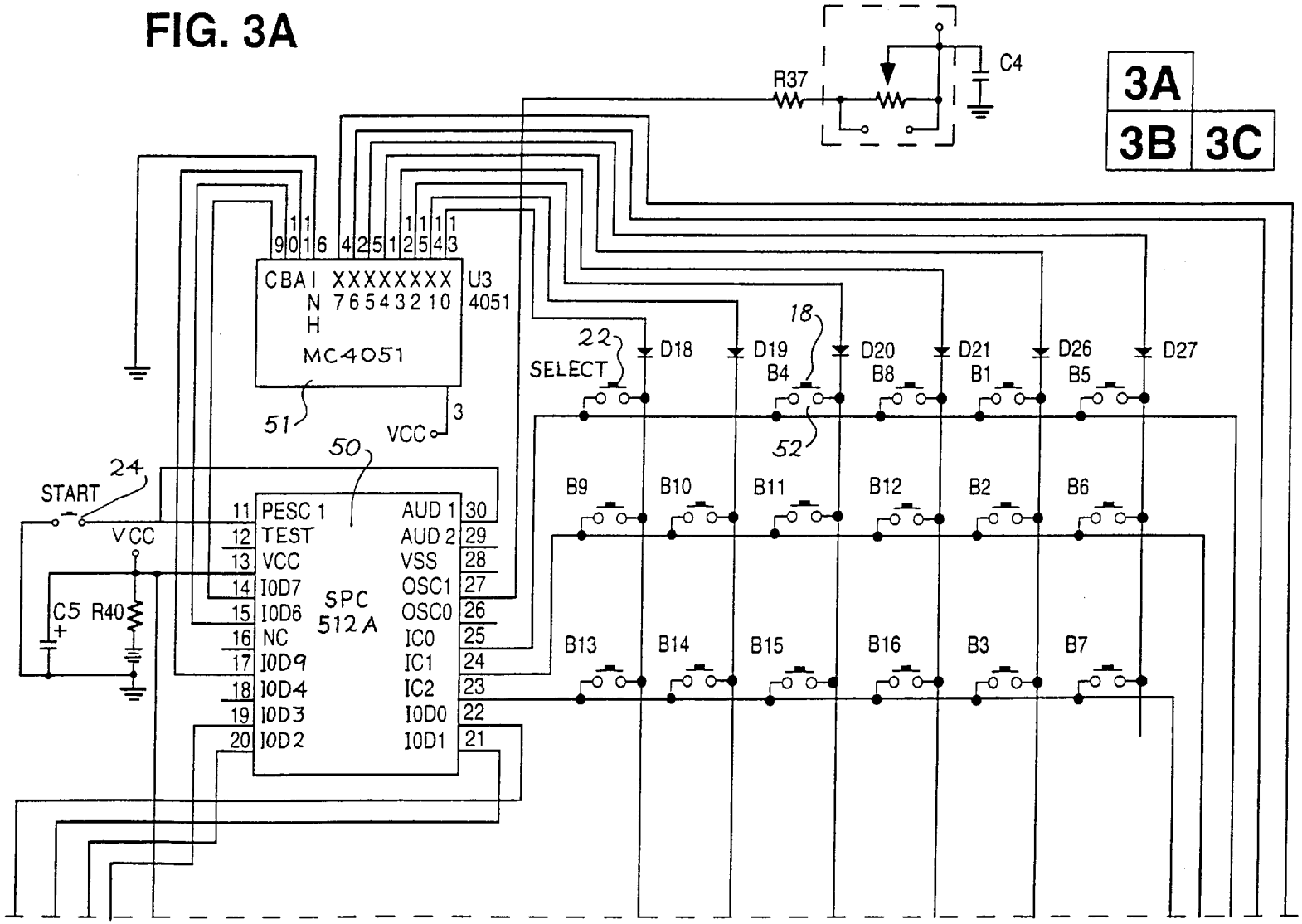
FIGS. 3A, 3B and 3C, taken together, form a circuit schematic of an electronic circuit portion of the game.
Figure 3B:
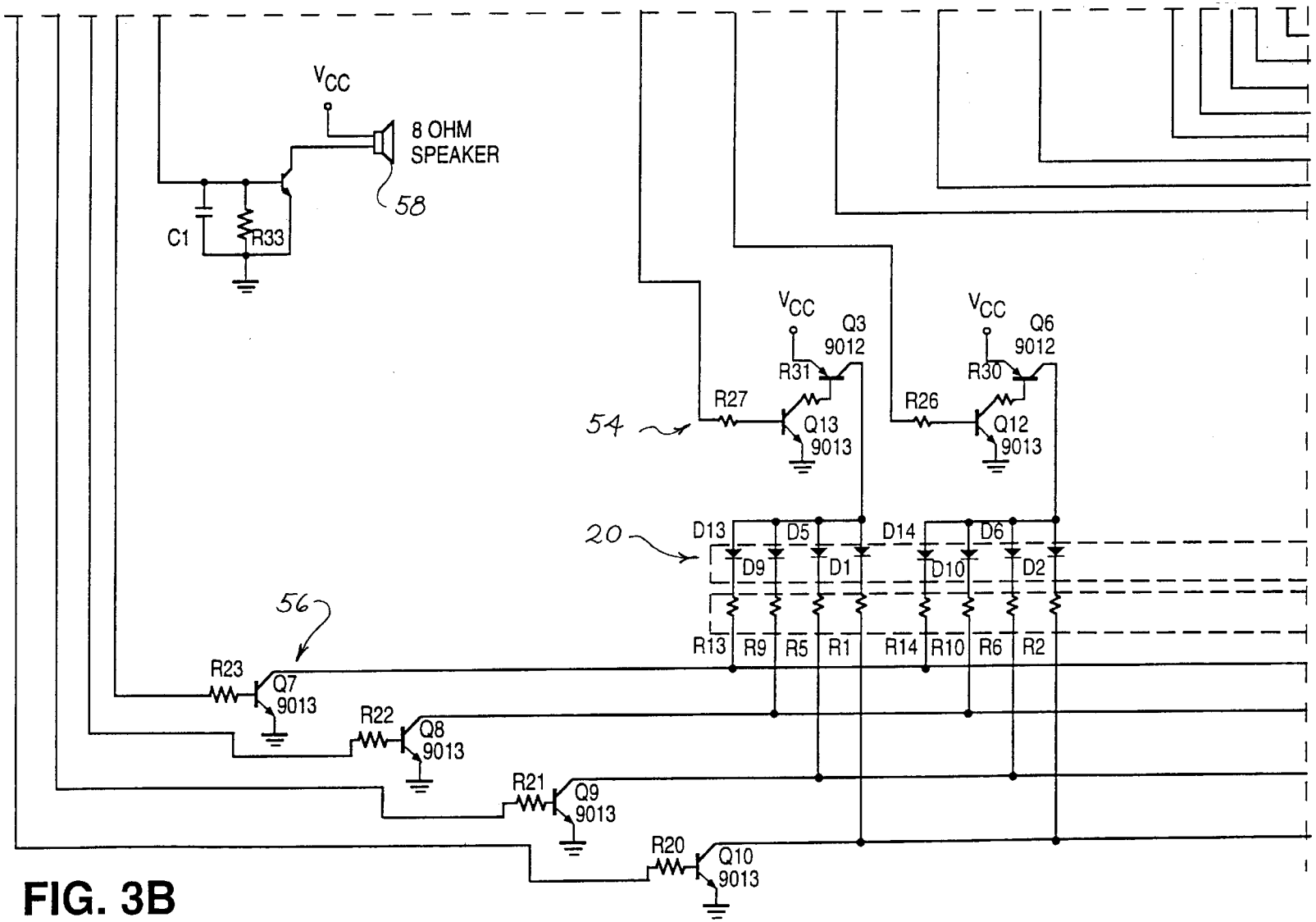
Figure 3C:
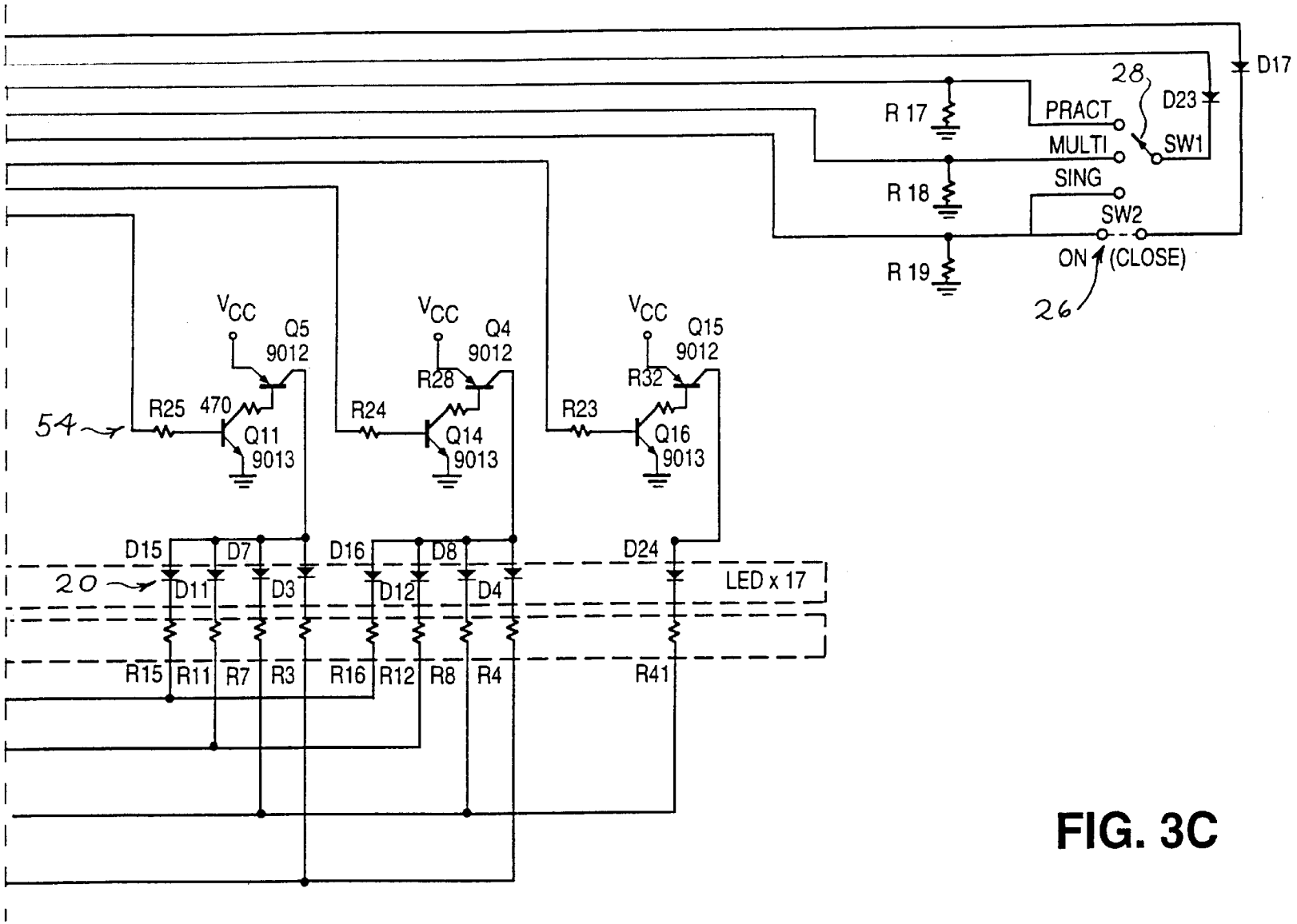

Referring to FIG. 3, a controller, preferably in the form of an electronic control integrated circuit 50, is operatively coupled with the space input devices, the space indicators and the select input device. As illustrated in FIG. 3A, each of the buttons 18 operates a contractor of a corresponding switch 52. These switches 52 are coupled in circuit with the electronic controller 50 through an interface component 51. Similarly, each of the LEDs 20 is operatively coupled with the electronic controller 50 by way of respective transistorized switching circuits 54 and 56 which electrically arrange the LEDs in a four-by-four array corresponding to the array of spaces 16 on the exterior face of the game housing 12.

In the illustrated embodiment, the electronic controller 50 comprises a CPU such as an SPC512A from Sunplus of Hsiu Chu, Taiwan, and the interface 51 comprises a keyboard multiplexer such as an MC 4051 from Motorola.

In accordance with the illustrated embodiment, the electronic controller 50 also includes an audio signal generator which is operatively coupled with a speaker 58 which is mounted to the game housing 12. The speaker 58 is responsive to the audio signal generator included within the controller 50 producing sounds corresponding to audio signals produced by this audio signal generator.

In operation, the electronic controller 50 is responsive to the operation of the select input device or switch 22 for activating its audio signal generator to produce a first audio signal which is sounded by the speaker 58. Similarly, the controller 50 is responsive to the activation of each space input device or button 18 for causing its audio signal generator to produce a "space" audio signal uniquely associated with each space of the spaces 16. At least one of these "space" audio signals corresponds to the first audio signal which was produced in response to operation of the select button 22. Preferably, the audio signals initially assigned to each of the spaces 16 remain in effect throughout the game, whereas the audio signal generated in response to the operation of the select button 22 is changed with each activation thereof. The electronic controller 50 also includes "shuffling" means for reassigning the audio signals among the spaces 16, preferably at the start of each new game.

In the event the audio signal corresponding to the selected button 18 matches the audio signal produced in response to the select switch 22, the illuminating means or LED 20 associated with that button 18 will be energized or illuminated. In the preferred form of the game, the player to illuminate the last of four buttons 18 in a line either vertically, horizontally or diagonally, is declared the game winner, without regard for which player or players illuminated the other buttons in the linear group of four.

Figure 2:
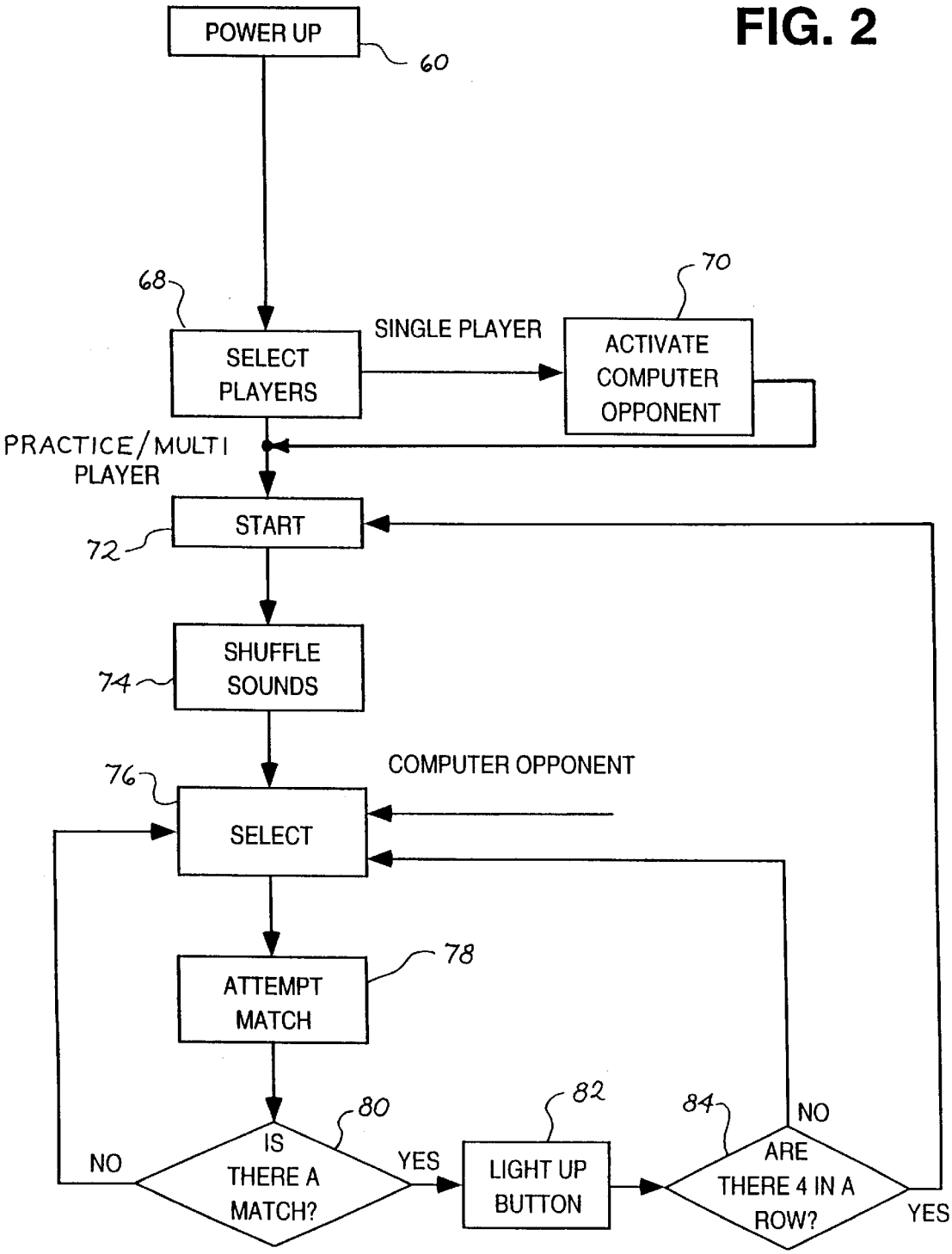
FIG. 2 is a flow diagram detailing operation of the game.

Referring now to FIG. 2, the general method of playing the game is illustrated diagrammatically in a flow chart. Initially, the game is turned on by activating the off/on switch 26 to its on position as indicated in FIG. 2 at reference numeral 60 (POWER-UP).

Next, the player selection switch 28 is activated to select either single player or multiple player or practice mode as indicated at 68 (SELECT PLAYERS). In the single player mode, the computer opponent is activated as indicated at 70. In the practice mode, the game will evaluate the player's performance by displaying the number of mistakes, i.e., failures to match the sounds. Also, in a practice game, the first time the player selects one of the sixteen buttons 18 is "free", i.e., it isn't counted as a mistake if the sound doesn't match the sound produced when the select switch 22 was activated. However, after that the button 18 is no longer "free" and counts as a mistake if its sound doesn't match.

At the end of a practice game, the number of mistakes made is indicated by flashing on the LEDs 20 behind the same number of buttons 18 briefly. If more than sixteen mistakes are made all sixteen buttons will flash once, then the number of buttons to make up the total will flash once. For example, for 23 mistakes, first all sixteen buttons 18 will flash, then the first 7 buttons will flash (16+7=23). For 37 mistakes, all sixteen buttons will flash, then all sixteen buttons flash again, then five of the buttons flash (16+16+5=37).

The game may then be commenced by activating the start button 24 as indicated at 72 (START). Activation of the start button 24 will cause the controller 50 to shuffle the sounds as indicated at 74 (SHUFFLE SOUNDS).

At this point, play is commenced by the first player activating the select button 22 as indicated at 76 (SELECT). This will cause the game to generate a sound to be matched by the player. One of the buttons 18 is then selected in an attempt to match (ATTEMPT MATCH 78) this generated sound. For each game or round of play, the same set of sounds is respectively assigned to the sixteen select buttons 18, only one of which matches the sound generated in response to activation of the select button on each turn. If the sound generated in response to activation of a given button 18 matches the sound generated in response to activation of the select button 22 (IS THERE A MATCH? 80), that button 18 will illuminate (LIGHT UP BUTTON 82) and remain illuminated until the end of the game.

In a preferred form of the game, when the player has successfully created a match, he retains his turn and plays again by again pressing the select button and again trying for another match, until he fails to select a matching sound. When the sounds do not match, the next player, or in the case of a single-player game, the computer opponent takes a turn. In the practice mode, a single player merely continues to play without regard to whether the sounds are matched or not.

The player who causes the last in a straight line of four of the buttons to be illuminated either vertically, horizontally, or diagonally (ARE THERE 4 IN A ROW? 84) is the winner, without regard for which player caused the other buttons in that line of four to be illuminated. At the end of the game, that is, with four lights in a row illuminated, the four lights will flash on and off with a "siren" sound effect.

A game may be terminated and a new game started, if desired, prior to this end point (four in a row) by either pressing the start button 24 to begin a new game in the same mode (single/multi/practice) or by selecting a new mode (with mode switch 28) and then pressing the start button 24. Of course, play may be terminated at any time by moving the on/off switch 26 to OFF.

The description of the preferred embodiments herein is not meant to limit the scope of the invention to the embodiments described, rather many elements of the claimed invention may have a number of alternates which function equivalently. The scope of the invention is expressed in the following claims.

What is claimed is:

1. An electronic game comprising:

a housing having an exterior a plurality of spaces on said exterior of said housing;

a space indicator corresponding to each of said spaces, each of said space indicators having an off-state and an on-state;

a space input device corresponding to each of said spaces for selecting the corresponding space;

a select input device; and an electronic controller disposed within said housing and operatively coupled with said space input devices, said space indicators and said select input device;

wherein said controller is responsive to activation of said select input device followed by activation of a predetermined one of said space input devices by causing the space indicator corresponding to said predetermined space input device to go to the on-state;

wherein said controller includes an audio signal generator for producing predetermined audio signals, wherein said controller is responsive to operation of said select input device for activating said audio signal generator to produce a first audio signal and is responsive to activation of each space input device for causing said audio signal generator to produce a space audio signal unique to each space, at least one of said space audio signals corresponding to said first audio signal, and wherein said controller includes shuffling means for reassigning said space audio signals among said space input devices.

2. A game according to claim 1 and further comprising a speaker mounted to said housing and operatively coupled with said audio signal generator and responsive to said audio signals for producing sounds.

3. A game according to claim 1 wherein said plurality of spaces are arrayed in a rectangular grid on the exterior of said housing.

4. A game according to claim 3 wherein said rectangular grid comprises sixteen spaces arranged in four rows and four columns.

5. A game according to claim 1 wherein each of said space input devices comprises a button disposed substantially within the space corresponding to said space inpit device.

6. A game according to claim 5 wherein each of said space indicators comprises illumination means located for illuminating the button disposed within the space corresponding to said space indicator.

7. A game according to claim 5 and further comprising a swithch corresponding to each of said buttons, and in electronic communication with said electronic controller.

8. A method for playing a game using a select input device and a plurality of spaces, said method comprising the steps of:

a) assigning a distinct human perceptible indication selected from among a predetermined plurality of human perceptible indications to each of said plurality of spaces;

b) assigning one of said plurality of predetermined human perceptible indications assigned to said spaces to said select input device;

c) choosing one of said spaces and displaying a space indicator corresponding to said space in response to choosing said space if said human perceptible indication assigned to said space corresponds to said human perceptible indication assigned to said select input device;

d) assigning a new human perceptible indication selected from among said plurality of human perceptible indications assigned to said spaces to said select input device;

e) repeating steps c) and d) until said space indicators are displayed in a predetermined pattern.

9. A method according to claim 8 wherein said at least one of said human perceptible indications is auditory.

10. A method according to claim 8 wherein said space indicator includes an illuminable lamp.

11. A method according to claim 8 wherein said predetermined pattern includes a plurality of linearly arranged displayed space indicators within a rectangular grid of space indicators.

* * * * *